United States Patent [19]

Walthew

[11] 4,035,751

[45] July 12, 1977

[54] DEVICE FOR INDUCING AN ELECTRICAL VOLTAGE

[76] Inventor: Ainslie Walthew, 178 Ayres Road, Old Trafford, Manchester, England, M16 9QB

[21] Appl. No.: 580,673

[22] Filed: May 27, 1975

[51] Int. Cl.[2] ..... H01F 27/08; H01F 27/24

[52] U.S. Cl. ..... 336/60; 336/83; 336/107; 336/212; 336/233; 336/234

[58] Field of Search ..... 336/83, 84, 212, 233, 336/234, 105, 107, 90, 94, 60, 92, 192, 206

[56] References Cited

U.S. PATENT DOCUMENTS

| | | | |
|---|---|---|---|
| 1,533,797 | 4/1925 | Greiff et al. | 336/212 X |
| 1,708,211 | 4/1929 | Bates | 336/234 X |
| 1,784,827 | 12/1930 | Elmen | 336/234 X |
| 1,880,805 | 10/1932 | Christopher | 336/234 |
| 2,478,983 | 8/1949 | Runbaker et al. | 336/94 X |
| 2,512,796 | 6/1950 | Hartzell | 336/94 X |
| 2,688,650 | 9/1954 | Knopp et al. | 336/94 X |
| 2,701,345 | 2/1955 | Henry | 336/83 X |
| 3,423,710 | 1/1969 | Allen | 336/212 X |
| 3,633,140 | 1/1972 | Lake | 336/205 |
| 3,720,897 | 3/1973 | Feather et al. | 336/60 |
| 3,739,255 | 6/1973 | Leppent | 336/212 X |
| 3,748,616 | 7/1973 | Weber et al. | 336/60 |

*Primary Examiner*—Thomas J. Kozma
*Attorney, Agent, or Firm*—James E. Nilles

[57] ABSTRACT

A device for inducing an electrical voltage comprises primary and secondary windings wound round a core. The core has a first part responsive to high frequencies and a second part responsive to low frequencies. The axial length of the first part does not exceed the axial length of the second part, but exceeds the axial length of primary and secondary windings.

23 Claims, 9 Drawing Figures

DEVICE FOR INDUCING AN ELECTRICAL VOLTAGE

BACKGROUND OF THE INVENTION

Field of Use

The present invention relates to a device for inducing an electrical voltage and in particular to a coil for the ignition systems of automobile/marine and/or aircraft internal combustion engines.

SUMMARY OF THE PRESENT INVENTION

According to the present invention, there is provided a device for inducing an electrical voltage comprising a core having a first part responsive to higher frequencies and a second part responsive to very low frequencies and having an axial length not exceeding the axial length of the first part but exceeding the axial length of the primary and secondary inductances wound round the core.

In one preferred embodiment, the core comprises a ferrite tube filled with a plurality of iron rods.

In another preferred embodiment, the core comprises a solid ferrite rod in a tube of ferrite of a different type. In a further preferred embodiment the core comprises a solid ferrite rod with a plurality of soft iron rods surrounding it.

Advantageously, the inductances are wound on a tubular former made of synthetic plastics material and preferably this former is circumferentially splined to provide axially extending channels.

Also advantageously, adjacent layers of the primary inductance are separated by circumferentially extending layers of ribbed flexible synthetic plastics material which also form axially extending channels.

During use insulation oil circulates through the axially extending channels by capillary action.

DRAWINGS

In order that the invention may be more clearly understood, one embodiment of the invention will now be described, by way of example, with reference to the accompanying drawings in which:

FIGS. 1A, 1B, 1C, 1D, and 1E show in cross section five forms of core for a coil for internal combustion engine ignition systems;

DESCRIPTION OF PREFERRED EMBODIMENTS

Figure 2:
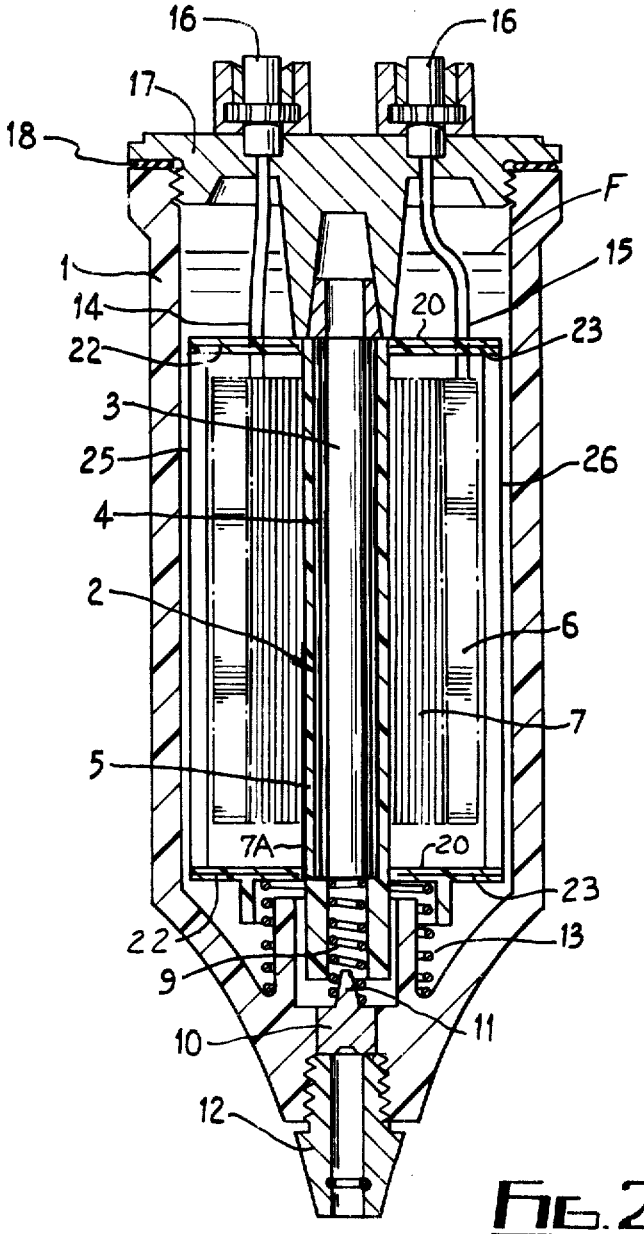
FIG. 2 shows a cross sectional view of a coil having a core as shown in FIG. 1B.

Referring to FIG. 2 of the drawings, the coil comprises a pressure moulded synthetic plastics material housing capsule 1 in which a core arrangement indicated generally by the reference numeral 2 and winding arrangement are disposed. The core arrangement 2 comprises a central core consisting of a solid cylindrical central ferrite portion 3 surrounded by a plurality of 19 SWG soft annealed iron rods 4 secured together with an air-drying epoxy resin such as "Araldite" (Registered Trade Mark). The axial length of the rods is 109 mm and of the ferrite portion 109 mm. The diameter of the ferrite portion is 10 mm, the diameter of each soft iron rod is 19 SWG and forming the external diameter of the core is 16 mm.

A former 5 of synthetic plastics material fits over the core 2 and provides a support for the windings. It is important that the axial length of the windings should be a little less than that of the core. There is a primary winding 6 and a secondary winding 7. The primary winding 6 is wound over the secondary winding 7 with suitable insulation disposed therebetween. This winding 6 consists of flat section or paired copper conductors. Between adjacent layers of the winding 6 there are disposed layers of ribbed polytetrafluoroethylene, the ribs 8 of which run axially of the core and form channels through which cooling and insulating oil can circulate by capillary action. The inner start layer of the primary 6 is looped and connected to the outer last turn of the secondary 7, the tail of which is then sleeved and brought out of one end of the windings through the end cheek positive connection 14 and the first turn of the secondary 7 leads out straight to the high tension connection as at 7A. The secondary inductor winding 7 is constructed with "Lewmex" enamelled and/or plastic covered conductor, interleaved with two layers of varnish impregnated glass fibre craft paper between every layer of wound conductors. The tube former 5 on which this section is wound is splined to provide for complete oil circulation, insulation and cooling. It is injection moulded and/or extruded in a high dielectric and mechanical strength plastic material "Makarlon" or "Kematal". The start end of the winding 7 is soldered into a folded end of a flat length of tinned copper ribbon 7A, the ribbon is then passed through a small slot provided at the bottom of one of the splines in the former 5, and the soldered section laid flat within the spline well and then secured and sealed with "Araldite". The tail end of the ribbon is then laid flat along the inside wall of the former 5 and out at the opposite end to the low tension connections. When the secondary and primary windings are complete, the last turn of the primary is sleeved looped and secured. The tail is then brought out through the end cheek negative connection. The core assembly matrix is then inserted into the tube former 5 at the opposite end to where the electrical high tension conductor ribbon protrudes. The core is then carefully positioned. A small pulsed electrical potential is applied to the primary winding 6 and with the use of a suitable electrical instrument the core is focused within the windings for maximum output, and minimum magnetizing current. Having completed this operation, the tail of the ribbon conductor 7A is soldered to the electrical high tension negative to ground connection. This high tension connection comprises a phosphor bronze spring 9 which is in contact with a one piece plated brass moulding insert 10. The spring 9 is centered and secured to and with the core matrix within the tube former, using "Araldite" for securing and sealing. The insert 10 has a tapering dowel 11 to locate the spring 9 thereon and is disposed in an aperture in the housing 1. A ½ inch B.S.F.H.T. cable securing connector 12 is screwed into the aperture for this purpose.

In an advantageous alternative form, the phosphor bronze spring 9 is replaced by a beryllium-copper spring and the insert 10 is replaced by a plated brass oil and vacuum securing screw complete with a "Nylite" seal.

A polytetrafluoroethylene coated phosphor bronze spring 13 is disposed between the former 5 and a recess suitably formed in the interior wall surface of the housing. Alternatively, the spring 13 may be replaced by beryllium copper wavy washers disposed at opposite ends respectively of the former.

At the other end of the housing are the conductors 14 and 15 positive or negative to the primary winding which are crimped into connectors 16 disposed in respective apertures in the end of the cover 17 of housing 1. The inside faces of the cheeks 20 of the former abutting the windings are preferably grooved to allow passage of cooling oil through to the core. This end of the housing comprises a plate 17 which screws into the open end of the remainder of the housing 1. A neoprene O-ring seal 18 is disposed between the plate 17 and the remainder of the housing 1. The housing is filled to line F in FIG. 2 with transformer oil for insulation and cooling. Before filling, the assembly is preheated. After filling, the coil is then subjected to low cyclic operation, then fully evacuated and refilled to level via screw 10 in the high tension tower. The screw 10 is substantially sealed.

The channels defined between the splines of the former provide for the passage by capillary action of insulating and cooling oil. End cheeks 20 (see FIG. 4) are disposed at opposite ends respectively of the former 5. Each end cheek 20 comprises two Stalloy and/or malleable 0.5 mm iron parts 22 and 23 constituting a split magnetic proximity disc encapsulated in synthetic "Makrolon" (Bayers) plastic material. Stalloy is on alloy of iron which has materials in the following percentages: 0.03 carbon, 3.4 silicon, 0.04 sulfur, 0.01 phosphorus, 0.32 manganese and 96.2 iron. Each part 22, 23 is substantially semi-circular and an outer diameter of 48 mm, a thickness of ⅛ and a substantially semi-circular recess having a diameter of 18 mm. Three tabs 24 approximately 3 mm × 2 mm extend from each part and out of the synthetic plastics encapsulating material. These two sets of three tabs respectively contact one end of each of two Stalloy or iron half shells 25, 26 (93 mm long by 0.5 mm thick) which extend between the two end cheeks. Each half shell, 25, 26 is slotted at 27 (slot is 2.5 mm wide by 1 mm) to accommodate the tabs 24 of the two end cheeks located at opposite ends. The end cheeks combined with the half sheets concentrate a portion of the magnetic flux path within the inductor coil assembly, thereby reducing the effective air gap to about twice the thickness of the primary and secondary winding combined.

Figure 1A:
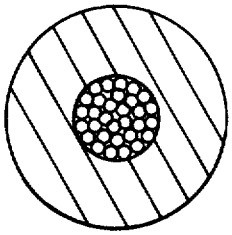
Figure 1B:
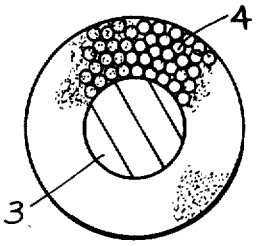
Figure 1C:
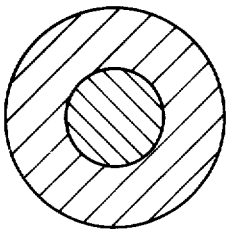
Figure 1D:
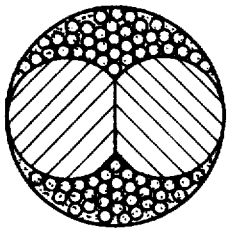
Figure 3:
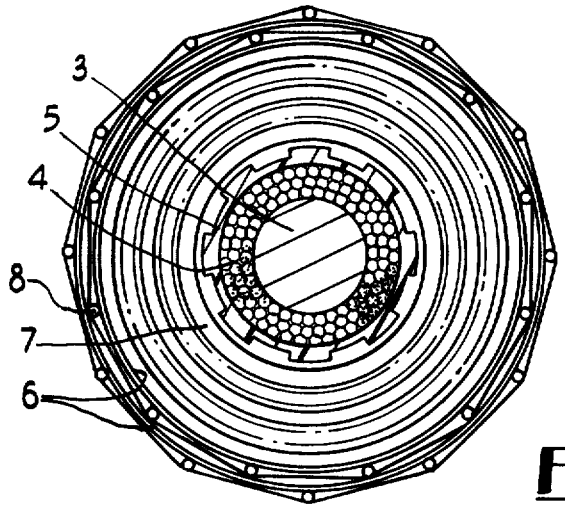
FIG. 3 shows an enlarged cross sectional view of core and windings for the coil of FIG. 2.
Figure 4:
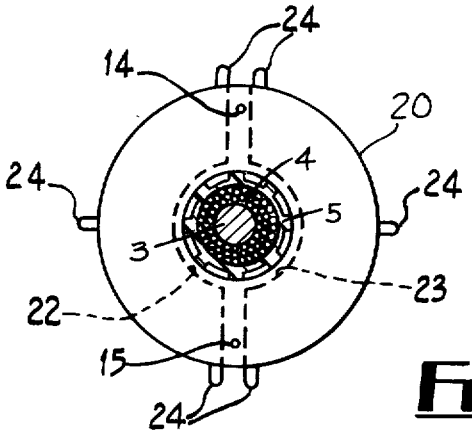
FIG. 4 shows an end check for use with the former of FIG. 2.
Figure 5:
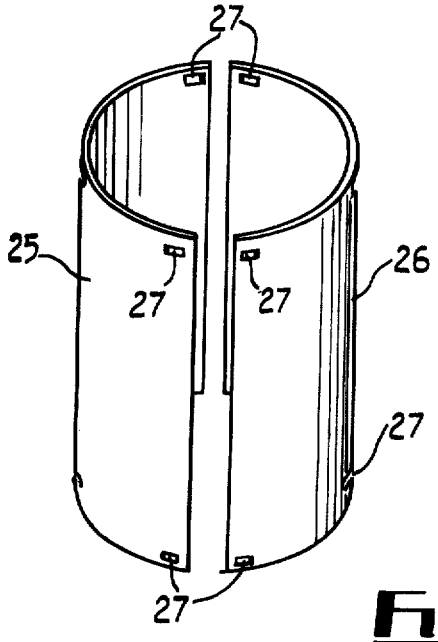
FIG. 5 shows magnetic circuit body shells for use with the cheeks and former of FIGS. 2, 3 and 4.

The core described in FIGS. 2, 3 and 4 is shown in FIG. 1B with a ferrite centre and soft iron rods surrounding the ferrite centre. Alternative forms of core assembly are also shown, the one in FIG. 1A having a thickwalled ferrite tube filled with soft iron rods. In an alternative form (shown in FIG. 1C) a solid ferrite rod extends through a ferrite tube of dissimilar characteristics and structure. In all forms of core, however, there is a low frequency part and a high frequency part. There is no limitation as to the material chosen for the inner and outer parts of the core as long as one part has a very low frequency response and the other a high frequency response.

The above described core assembly enables a greater output voltage and velocity plasma to be developed and maintained over wider frequency range than with comparable conventional ignition coils. This is of particular importance in internal combustion engine applications as inefficient sparking resulting from low output coil voltage does lead to poor starting, incomplete combustion and poor general performance and environmental pollution. The location of the low tension connectors at the opposite end of the coil from the high tension connector considerably reduces the possibility of short circuiting or carbon tracking.

In internal combustion engine applications, for example, the coil is secured in the engine compartment by means of an omega-shaped moulded synthetic plastics material clip (not shown), with the round part of the clip fitting round the coil and the 2 feet having elongated apertures therein through which securing screws can be inserted. A projection and complementary aperture are formed on respective opposite inside surfaces of the clip at the neck of the latter which engage and secure when pressed together. The material of the clip is preferably DELRIN (Registered Trade Mark).

Figure 1E:
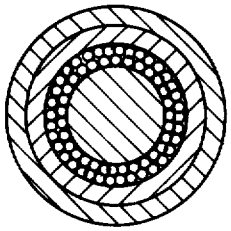

It will be appreciated that the above embodiments have been described by way of example only and that many variations are possible without departing from the scope thereof. For example, a printed circuit system may be used for the secondary winding. The core arrangement of ferrite and iron rod may be different to those shown. As FIG. 10 shows, two high frequency responsive ferrite rods of 3/4 round shape can be placed with their flat sides together and the low frequency responsive iron rods placed to the side of the ferrite rods to make up a core of overall circular section. In a more complex core, there may be four parts, as shown in FIG. 1E. In FIG. 1E a central ferrite rod for very low frequency is surrounded by a plurality of low frequency responsive iron rods. These rods are in turn surrounded by a ferrite tube responsive to high frequency. A further ferrite tube responsive to a very high frequency completes the core.

It is intended to employ transistorized switching with the above described ignition coil. This switching would be achieved by means of a transistorized module which would be connected to the coil through the connector 16. For this purpose in order to avoid polarity reversal the two connectors 16 are made dissimilar. For cooling purposes the external surface of the module would preferably be finned and the electronic section thereof fitted under a cover plate on a copper chassis which, when screwed down, makes sure mechanical contact with the mechanical interior surface of the heat sink well. This module could also be filled with insulating and cooling oil. The module itself is 3/4 round in shape and encompasses the upper half of the coil module assembly. The flat section is part slotted to accommodate centre support lugs of the mounting bracket for the coil.

In the above arrangements the synthetic plastics insulation has a high dielectric and a high mechanical strength.

It will be appreciated that the above described embodiments have been described by way of example only and that many variations are possible without departing from the scope of the appended claims. For example, the two part core may comprise a solid cylindrical central inner core part of a ferrite high frequency matrix and/or eutectic ferrite and a hollow tubular outer core part, which fits over the inner core part with an interference fit and is cemented thereto, of a malleable very low frequency iron (ferrite matrix) and/or ferrocart. Alternatively, the two part core may comprise a solid cylindrical inner core part of a malleable very low freuquency iron (ferric matrix) and/or ferrocart and a hollow tubular outer core part, fitted as detailed above, of a ferrite high frequency matrix and/or a eutectoid ferrite.

I claim:

1. An ignition coil for a spark ignition internal combustion engine comprising a housing, an open linear core disposed in said housing, primary and secondary inductance windings wound round said core, said core having a first part responsive to higher frequencies and a second part responsive to very low frequencies, said second part of said core having an axial length not exceeding the axial length of the first part of said core but exceeding the axial length of the primary and secondary inductance windings wound round the core, at least one of said parts of said core being a ferrite, and a body of oil in said housing in which said core and windings are immersed, said housing having a vacuum maintained therein.

2. A coil as claimed in claim 1, in which the core comprises a ferrite matrix tube filled with a plurality of malleable iron rods.

3. A coil as claimed in claim 1, in which the core comprises a solid ferrite matrix rod with a plurality of malleable iron rods surrounding it.

4. A coil as claimed in claim 1, in which the core comprises a solid ferrite matrix rod disposed in a solid tube of a ferrite matrix of a different type.

5. A coil as claimed in claim 1, in which the core comprises two ferrite matrix rods surrounded by a plurality of malleable iron rods.

6. A coil as claimed in claim 1, in which the core comprises a ferrite rod, a plurality of iron rods surrounding the ferrite rod, a ferrite tube surrounding the iron rods and a further ferrite tube surrounding the first ferrite tube, the ferrite of the rod and tubes being of different types.

7. A coil as claimed in claim 1, in which the core is housed in a tube forming part of a former.

8. A coil as claimed in claim 7, in which the tube is made of synthetic plastics material.

9. A coil as claimed in claim 7, in which the tube is externally splined to provide axially extending channels for the passage of coolant.

10. A coil as claimed in claim 7, in which the secondary inductance winding is wound on the former and the primary inductance is wound over the secondary inductance winding.

11. A coil as claimed in claim 1, in which adjacent layers of the primary inductance winding are separated by circumferentially extending layers of ribbed flexible synthetic plastics material, the ribs defining channels for the circulating of coolant.

12. A coil as claimed in claim 9, in which the channels are such as to enable the coolant to circulate by capillary action.

13. A coil as claimed in claim 7, in which the former comprises end cheeks disposed at opposite axial ends respectively thereof.

14. A coil as claimed in claim 13, in which the end cheeks are separate from the tubular part of the former.

15. A coil device as claimed in claim 14, in which each end cheek comprises two substantially semi-circular metal plates encapsulated in synthetic plastics material and each plate comprises one or more lugs extending from the periphery out of the synthetic plastics material, and defines a substantially semi-circular recess which receives one end of the tubular part of the former.

16. A device as claimed in claim 15, in which two half shells surround the primary and secondary inductance windings, each half shell having one or more axial shifts to receive respective lugs off corresponding plates of the end cheeks.

17. A coil as claimed in claim 16, in which the end plates are made of a material selected from a group consisting of Stalloy and malleable iron.

18. A coil as claimed in claim 16, in which the half shells are made of a material selected from a goup consisting of Stalloy and malleable iron.

19. A coil as claimed in claim 1, in which the connectors to the primary inductance winding are disposed at the opposite axial end of the core to the connector for the secondary inductance.

20. A coil as claimed in claim 1, in which the connector to the secondary winding is phosphor bronze spring connected to a onepiece brass insert.

21. A coil as claimed in claim 1, in which the connector to the secondary winding is a beryllium-copper spring connected to a plated brass oil and vacuum securing screw.

22. A coil as claimed in claim 1, in which the secondary inductance winding comprises an insulated conductor interleaved with two layers of varnish impregnated glass fibre craft paper between adjacent layers of the winding.

23. A coil as claimed in claim 1, in which said housing for the inductance windings synthetic plastics material.

* * * * *